US007533627B2

(12) United States Patent
Wooldridge

(10) Patent No.: US 7,533,627 B2
(45) Date of Patent: May 19, 2009

(54) BOAT HULL WITH PROTECTIVE SURFACE

(76) Inventor: Glen R. Wooldridge, 3729 S. 188th St., Seatac, WA (US) 98188

( * ) Notice: Subject to any disclaimer, the term of this patent is extended or adjusted under 35 U.S.C. 154(b) by 0 days.

(21) Appl. No.: 11/831,849

(22) Filed: Jul. 31, 2007

(65) Prior Publication Data

US 2008/0022917 A1 Jan. 31, 2008

Related U.S. Application Data

(60) Provisional application No. 60/834,585, filed on Jul. 31, 2006.

(51) Int. Cl.
*B63B 17/00* (2006.01)

(52) U.S. Cl. ..... 114/361

(58) Field of Classification Search ..... 114/361
See application file for complete search history.

(56) References Cited

U.S. PATENT DOCUMENTS 1,136,711 A * 4/1915 Paulauski ..... 114/68
3,270,701 A * 9/1966 Kubas ..... 114/121
3,680,516 A * 8/1972 Loverdos-Stelakatos .. 114/67 R
5,117,764 A * 6/1992 Kretzer, Jr. ..... 114/361
6,158,376 A * 12/2000 Vorus ..... 114/279
6,530,337 B1 * 3/2003 Hoffman ..... 114/361

* cited by examiner

*Primary Examiner*—Jesus D Sotelo
(74) *Attorney, Agent, or Firm*—Christensen O'Connor Johnson Kindness PLLC

(57) ABSTRACT

A boat hull shield is disclosed including a hull perimeter bracket adapted to attach to a boat hull, the bracket extending along a port and a starboard chine of the boat hull. The hull shield further includes a convex panel, with a low-friction hard surface, for covering a bottom surface of the boat hull, having an outer edge retained by the bracket, extending from the port chine to the starboard chine of the boat hull, the convex panel forming a hollow space between the convex panel and the boat hull. A trim component is included in the hull shield which is attached to the aft end of the boat for adjusting an angle of a surface of the convex panel. The hull shield also includes a suspension component for absorbing impact force on the low-friction hard surface of the convex panel.

23 Claims, 3 Drawing Sheets

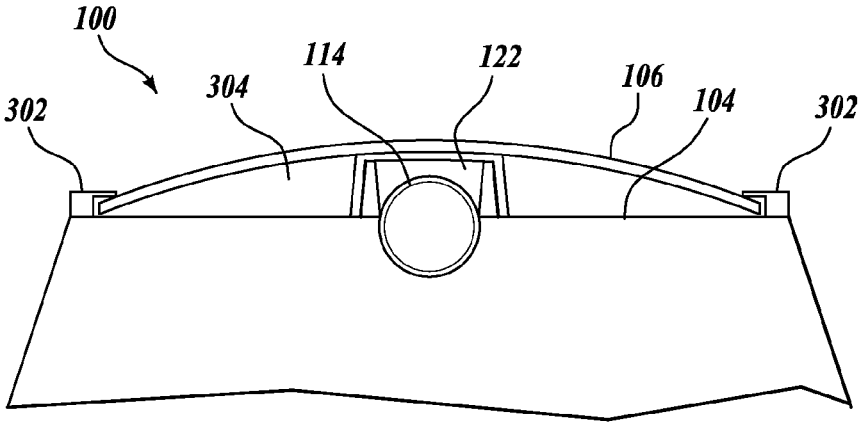
Fig.3A.
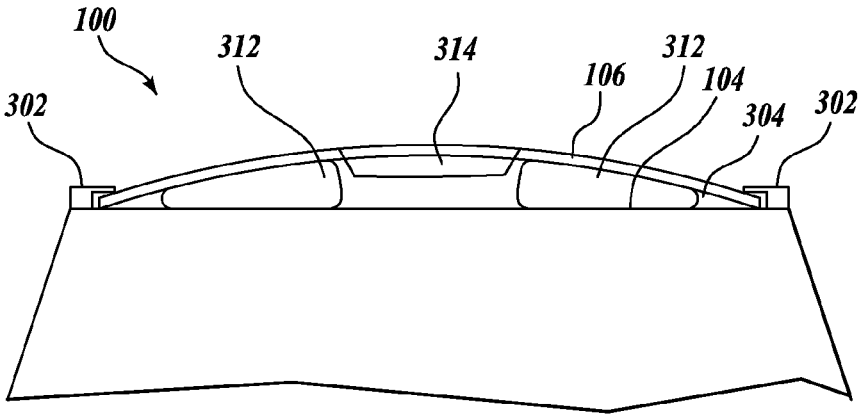
Fig.3B.
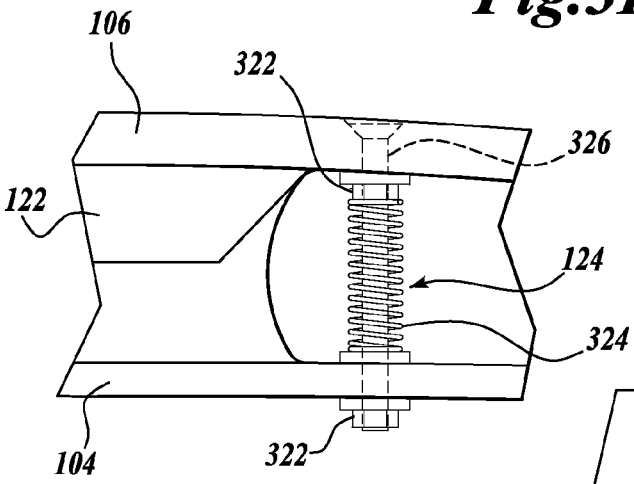
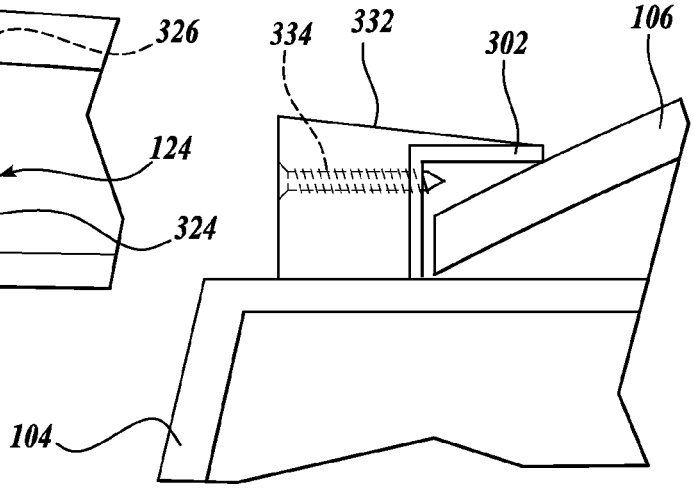
Fig.3C.
Fig.3D.

BOAT HULL WITH PROTECTIVE SURFACE

CROSS-REFERENCE TO RELATED APPLICATION

This application claims the benefit of U.S. Provisional Patent Application No. 60/834,585, filed Jul. 31, 2006, the disclosure of which is hereby expressly incorporated by reference in its entirety, and priority from the filing date of which is hereby claimed under 35 U.S.C. § 119.

BACKGROUND

Boats running in shallow, rocky water conditions can sustain major damage on impact with underwater obstacles. To avoid damaging the hull, various techniques have been attempted, including application or attachment of a coating or a protective plate. None have been satisfactory.

Prior designs contemplate attaching plastic directly to the bottom of the hull using different methods. Some drill tapered holes in the plastic then weld in tapered aluminum washers to the aluminum hull. Some glue or glue and vacuum plastic to the hull. More common is to bolt the plastic through the hull every few inches. In some cases, drilling through the hull and bolting, sometimes drilling through and taping, into the aluminum hull. These various ideas to secure the plastic directly to the hull make a slippery surface if the bat comes in contact with the river bottom, but have many drawbacks, including:

1. Drilling lots of holes in the hull can lead to leaks as the bottom hits and slides on rocks, it can loosen and bend the attaching bolts, which can result in leaks and the plastic separating from the boat bottom;
2. When the plastic is attached in so many spots, it tends to buckle and wave when it changes temperature and the boat performance is reduced due to a deformed running surface;
3. Gluing is a problem as the plastic expands at a different rate than the boat hull in different temperatures and tends to break free; and
4. The main problem is that when a large rock is hit and the plastic is attached directly to the hull, the hull will receive the impact and be damaged.

Therefore, there is a need for a hull shield to avoid the aforementioned disadvantages.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In the present invention, the hull shield is provided by arching a tough, slippery material, that is relatively resilient, such as, but not limited to, plastic or polyethylene, and attaching the hull shield to the boat hull to create a new planing surface to all or part of the hull. Strength and rigidity of the structure are enhanced through arching and the arching results in a desired spacing between the hull shield and the original boat hull along most of the surface, to make impact without damaging the original hull bottom and structure. The drawings show the bottom of Wooldridge Boats, Inc., outboard jet boats with jet tunnel and inboard jet boats. The invention is applicable to inboard and outboards, propeller and jet designs.

It will be appreciated that this spacing between the hull and plastic may be left as air space or filled with the correct foam or other resilient type material.

It is very important to avoid damaging a hull when running shallow, rocky water conditions. The installation of a hull shield on the hull allows the hull to slide over a rock if it comes in contact. It will be advantageous to form the hull shield from a material that is tough enough to withstand impacts with rocks, and preferably being relatively smooth and hard, to promote sliding over rocks.

The spacing created by the arching of the hull shield in the present invention, allows the hull shield to absorb a blow and flex with the impact without damaging the boat hull as can happen when plastic is attached directly to a hull.

According to one aspect of the invention, a boat hull shield is disclosed including a hull perimeter bracket adapted to attach to a boat hull, the bracket extending along a port and a starboard chine of the boat hull. The hull shield further includes a convex panel for covering a bottom surface of the boat hull, having an outer edge retained by the bracket, extending from the port chine to the starboard chine of the boat hull, the convex panel forming a hollow space between the convex panel and the boat hull with the capability to flex, absorb, and deflect impact.

According to another aspect of the invention, a boat hull is disclosed including a hull perimeter bracket extending along a port chine and a starboard chine of the boat hull. The hull shield further includes a convex panel for covering a bottom surface of the boat hull, having an outer edge retained by the bracket, extending from the port chine to the starboard chine of the boat hull and extending from a bow end to an aft end of the boat hull, the convex panel extending beyond the aft end of the boat hull to form an aft overhang. A trim component is also included in the hull shield which is attached to the aft overhang for adjusting an angle of a surface of the convex panel.

According to yet another aspect of the invention, a boat hull is disclosed including a hull perimeter bracket extending along a port and a starboard chine of the boat hull. The hull shield further includes a convex panel for covering a bottom surface of the boat hull, having an outer edge retained by the bracket, extending from the port chine to the starboard chine of the boat hull and extending from a bow end to an aft end of the boat hull, the convex panel having a low-friction hard surface for sliding over hard obstacles. The hull shield also deflects on impact and creates a suspension component for absorbing impact force on a low-friction hard surface of the convex panel.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein:

FIG. 3A is a pictorial diagram of a rear view of the watercraft of FIG. 1 suitable for use with an inboard engine in an upside down position showing the separation between the hull shield and the hull, according to one embodiment of the present invention;

FIG. 3B is a pictorial diagram of a rear view of a watercraft with a jet tunnel, suitable for use with an outboard jet engine, in an upside down position;

FIG. 3C is a pictorial diagram of a detailed view of a trim component attached to the hull shield according to an embodiment of the present invention; and FIG. 3D is a detailed view of a chine according to another aspect of the present invention.

DETAILED DESCRIPTION

A watercraft moving in shallow waterways at high speed is exposed to underwater debris and obstacles, such as rocks, submerged trees, etc. To protect the boat hull from impact with such objects, a semi-rigid, flexible hull shield may be used. According to one illustrative embodiment, a semi-rigid, flexible hull shield is attached to the bottom surface of the boat hull by means of brackets extending along the port side (for example, at or near the chine of the hull) and the starboard side (for example, at or near the chine of the hull) of the boat hull. The hull shield includes a convex hard panel retained by the brackets and extending from the port bracket to the starboard bracket, substantially covering the bottom surface of the boat hull. In this embodiment, impacts from objects such as rocks are absorbed by the deflection of the convex panel constituting the hull shield, thus preventing the impact force from being transferred to and damaging the boat hull.

The following detailed description describes illustrative embodiments of the invention. Although specific operating environments, boat configurations, and hull designs may be illustrated and/or described, it should be understood that the examples provided are not exhaustive and do not limit the invention to the precise forms and embodiments disclosed. Persons skilled in the field of watercraft design, manufacture, and use will recognize that the components and process elements described herein may be interchangeable with other components or elements or combinations of components or elements and still achieve the benefits and advantages of the disclosure herein. Although the present description may refer to small watercraft with flat hulls, persons skilled in the art will recognize that other sizes and types of boats and environments may also be suitable for the present invention.

In the following description, numerous specific details are set forth in order to provide a thorough understanding of the disclosure. However, it will be apparent to one skilled in the art that the disclosure may be practiced without some or all of these specific details. In other instances, well-known components have not been described in detail in order not to unnecessarily obscure the disclosure.

A power boat may be powered by means of, for example, a propeller or a jet propulsion unit. Furthermore, the motor may be inboard mounted or outboard mounted. In shallow waters where natural barriers, such as rocks and riverbed, are located a few inches from the boat hull, propeller-driven boats are generally not suitable. In such environments, a jet propulsion unit is generally used where no drive component extends below the bottom surface of the boat hull.

Figure 1:
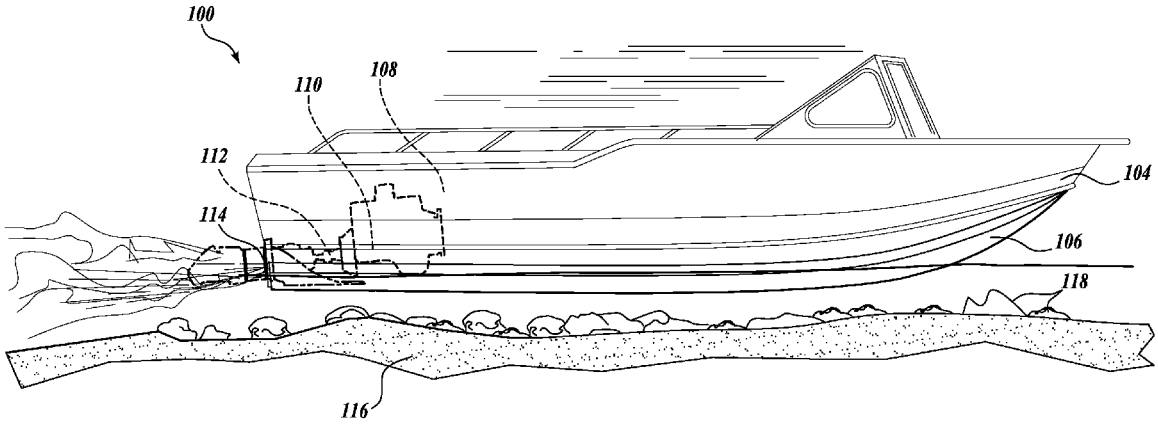
FIG. 1 is a pictorial diagram of a side view of a watercraft suitable for shallow water applications using a hull shield, according to one aspect of the present invention.

FIG. 1 is a side view of a watercraft 100 with an inboard jet propulsion unit in a shallow waterway. A jet propulsion unit for the boat 100 typically includes an engine 108, a coupling 110, a pump 112, and a nozzle 114. The engine 108, typically an internal combustion engine, drives the pump 112 through the coupling 110, taking in water from an inlet 124 and thrusting the water out from the nozzle 114, propelling the boat 100 forward. As noted above, the nozzle 114 or other drive components do not extend below the bottom surface of the hull 104, thus preventing impact with submerged objects, such as rocks 118. In this embodiment, a boat hull shield 106 is attached to the hull 104 to protect the boat hull 104 from impact with submerged objects, such as rocks 118 on the riverbed 116. In one illustrative embodiment, the hull shield 106 is a semirigid plastic plate with a hard slick surface that has a low friction coefficient reducing impact damage when encountering objects.

Figure 2:
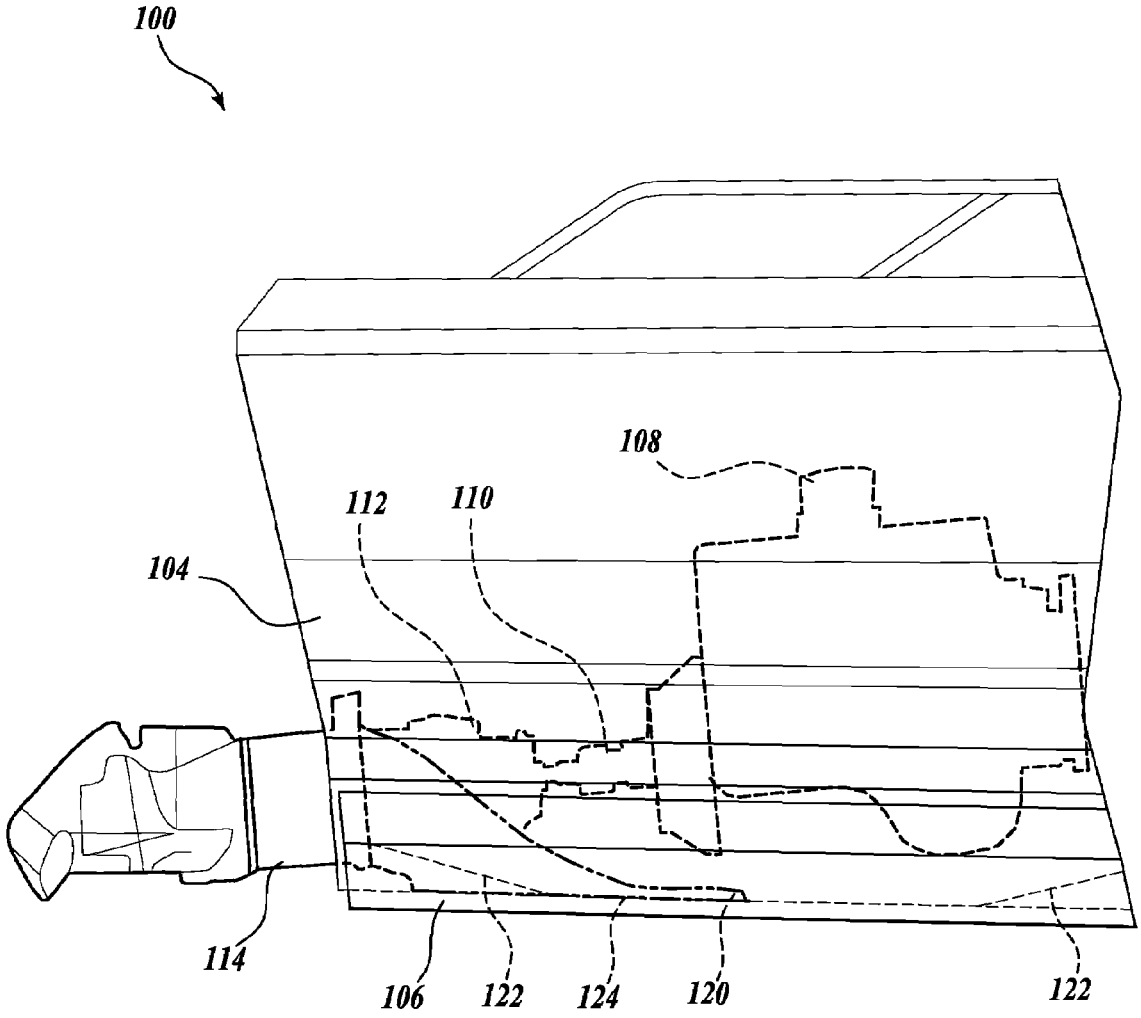
FIG. 2 is a pictorial diagram of a side view of the aft portion of the watercraft shown in FIG. 1.

As noted above, one or more internally mounted engines 108 may be used for boat propulsion. FIG. 2 shows a side view of the aft portion of the watercraft 100 shown in FIG. 1. In the jet propulsion unit shown in phantom, an engine 108 is coupled to a pump 112 through a coupling 110. Typically, a water inlet at pump 112 is provided to take water into the pump 112 from the river or lake where the watercraft is operating and thrusting the water out from nozzle 114 under high pressure to move the watercraft forward. In small boats, parts of the propulsion unit, such as the pump 112, may be in contact with the hull 104 and/or attached thereto. In one illustrative embodiment, the engine 108 is located within a pod area 120 provided within the hull 104. The pod area 120 is enclosed with reinforced walls 122 attached to the hull 104 to protect the drive components. The hull shield 106 encloses a portion of the hull 104 including the pod area 120. In one illustrative embodiment, the hull shield 106 is attached directly to the reinforced wall 122 of the pod area 120. In another illustrative embodiment, the hull shield 106 arches over the pod 120 to provide further protection from impact. In another illustrative embodiment, a trimming component 124 (see FIG. 3C) may be used in the aft section of the boat 100 to adjust the attitude of the boat 100 for improving performance.

The hull shield 106 is made from a resilient hard plate composed of a suitable material, such as hard plastic like ultra-high molecular weight (UHMW) polyethylene, laminated sheets, fiberglass, or any combination of the above. The hull shield may also be composed of a multi-layered composite material, each layer of which may provide a different desirable property, such as thermal stability, dent resistance, impact resistance, deformation resistance, and the like. Different parts of the hull shield 106 may also be composed of different materials suitable for different purposes. For example, the edges of the hull shield 106 where the hull shield 106 is coupled to the hull 104 may be composed of metal or metal alloys for strength and ease of attachment, and with UHMW polyethylene chine screwed on for protection, as shown in FIG. 3D, while the midsections of the hull shield 106 may be formed from hard plastic which is more dent resistant than metals. Those skilled in the art will appreciate that the hull shield 106 may be fabricated from many other types of materials or combination thereof without departing from the spirit of the disclosures herein.

FIG. 3A shows a rear view of the watercraft 100 shown in FIG. 1, utilizing an inboard engine, in an upside-down position. In one illustrative embodiment, extruded brackets 302 are attached to the boat hull 104 on both sides of the boat 100 along the length of the hull 104. In one illustrative embodiment, the brackets 302 are attached to the hull 104 by welding the brackets 302 to the hull 104. In another illustrative embodiment, the brackets 302 may be bolted to an edge overhang (not shown) of the hull 104. An edge overhang of the hull 104 may be an integral part of the hull 104 extending outside the sides of the hull 104 providing a narrow portion suitable for bolting the bracket 302 to the hull 104. In another illustrative embodiment, the bracket 302 may be an extruded profile fitted to a mating rail attached to the hull 104. The hull shield 106 is attached to the bottom of the hull 104 by means of the brackets 302, avoiding the need to directly attach the hull shield 106 to the hull 104 and allowing the hull shield 106 to move and flex. In one illustrative embodiment, the hull shield 106 is retained by the brackets 302 using an edge of the bracket 302. The hull shield 106 extends from a port chine of the hull to a starboard chine of the hull, held in place by the brackets 302. In one illustrative embodiment, the hull shield 106 covers the underside of the boat hull 104 from the aft end to the bow end of the boat 100. In another illustrative embodiment, the hull shield 106 covers a portion of the underside of the boat hull 104. In these illustrative embodiments, the hull shield 106 arches away from the hull 104 creating a space 304 between the hull shield 106 and the boat hull 104. The space 304 between the hull shield 106 and the hull 104 protects the hull 104 from impact of objects with the hull shield 106. When the hull shield 106 strikes an object, such as a rock, the hull shield 106 flexes in response to the force of impact and deflects toward the boat hull 104 avoiding or mitigating impact to the boat hull 104 and anything contained therein, such as the propulsion unit. The reinforced wall 122 of the pod area 120 is enclosed by the hull shield 106. In one illustrative embodiment, the pod area 120 is used to house the nozzle 114 extending out from the aft section of the watercraft 100.

In a preferred embodiment, the hull shield 106 is curved, forming a convex surface. The convex hull shield 106 provides a suspension system for the watercraft 100 moving on a body of water. FIG. 3B is a rear view of the watercraft 100 of FIG. 1, utilizing an outboard engine, in an upside-down position showing a space 304 between portions of the hull shield 106 and the hull 104, according to one embodiment of the present invention. In this illustrative embodiment, a Wooldridge Boats, Inc., outboard jet tunnel 314 may be utilized allowing an outboard jet propulsion system to be used, while protected by the tunnel 314 and hull shield 106 and without extending below the bottom surface of the boat hull 104. To further protect the hull 104 from impact with objects, suspension components 312 may be deployed between the hull shield 106 and the boat hull 104 in the space 304. The suspension component 312 may comprise, for example, an inflatable airbag or bladder, foam members, or other compressible members. The inflatable airbag may be inflated to different pressures to provide different levels of protection and smoothness of ride of the boat, analogous to tire pressure in a car. In another illustrative embodiment, the suspension component 312 includes a foam suitable for absorbing impact. It will be appreciated that the foam or the airbag may have added benefits such as adding buoyancy to the watercraft. In another illustrative embodiment, the suspension component 312 includes springs. For example, coil springs or leaf springs, or a combination of both, may be deployed within the space 304 between the hull shield 106 and the boat hull 104 to absorb impact energy during deflection of the hull shield 106 in response to impact forces. Those skilled in the art will appreciate that many other configurations may be used for suspension of the watercraft 100 without departing from the spirit of the present disclosures. In addition to providing a suspension system for the watercraft 100, some suspension components 312 may provide additional benefits.

The hull shield 106 is typically added to the normal configuration of the watercraft 100, thus the hull shield 106 may alter the performance characteristics of the watercraft 100 on water. It is advantageous to have means for controlling the shape and attitude of the hull shield 106, and in turn, beneficially affect the performance of the watercraft 100. As noted above, some of the suspension components 312 may be used to control the shape and curvature of the hull shield 106, for example, by increasing air pressure in an airbag.

FIG. 3C is a detailed view of a trim component 124 attached to the hull shield 106 and the hull 104. The trim component 124 is generally deployed in the aft section of the boat 100 to control the attitude of the boat by trimming the hull shield 106. In one illustrative embodiment, the trim component 124 includes a bolt 326 passing through a coil spring 324 and attaching the hull shield 106 to the hull 104 by means of a nut 322. In this embodiment, the trim component 124 may be attached to an aft section overhang (not shown), making drilling holes in, or using other invasive attachment techniques for attaching the trim component 124 to the hull 104 unnecessary. The coil spring 324 allows the hull shield 106 to deflect toward the hull 104 in response to an impact to the hull shield 106. The attitude of the boat may be adjusted by tightening or loosening the bolt 326, moving the hull shield 106 toward or away from the hull 104, respectively. The trim components 124 may be implemented by different means. For example, the trim component 124 includes a hydraulic or a pneumatic piston actuated by a hydraulic pump or an air pump, respectively. In another example, the trim component 124 may include a cam (not shown) coupled between the hull shield 106 and the hull 104 and rotatably adjustable to push the hull shield 106 toward or away from the hull 104, allowing adjustment of the attitude. The rotation of the cam may be controlled by an electric motor or manually.

The bracket 302 used for retaining the hull shield 106 may provide additional advantages aside from the retention of the hull shield 106. For example, the bracket 302 may be used to attach chines to add functionality and/or enhance performance of the hull 104. FIG. 3D is a detailed view of a chine 332 according to another aspect of the present invention. Chines are generally used on the perimeter of the boat hull 104 to provide desirable characteristics, such as enhancement of mobility in tight quarters, protection from side impact, and the like. In one illustrative embodiment, a chine 332 may be attached to the bracket 302 by means of a screw 334. In another illustrative embodiment, the chine 332 may be welded to the bracket 302. In yet another illustrative embodiment, the chine 332 may be attached to the bracket 302 by means of adhesives.

While illustrative embodiments have been illustrated and described, it will be appreciated that various changes can be made therein without departing from the spirit and scope of the invention.

The embodiments of the invention in which an exclusive property or privilege is claimed are defined as follows:

1. A boat hull shield comprising:

a hull perimeter bracket adapted to attach to a boat hull, the bracket extending along substantially the entire length of a port side and a starboard side of the boat hull including over a bow end of the boat hull; and a convex panel for covering a bottom surface of the boat hull, having an outer edge including a port side edge and a starboard side edge, the entire port side and starboard side edges engaging the bracket, such that the convex panel is spaced away from the hull along a central portion of the convex panel, the convex panel forming a hollow space between the convex panel and the boat hull;

wherein the convex panel covers substantially the entire bottom surface of the boat hull extending from a port chine to a starboard chine of the boat hull and from an aft end to the bow end of the boat hull.

2. The boat hull shield of claim 1, wherein the convex panel extends beyond the aft end of the boat hull to form an aft overhang.

3. The boat hull shield of claim 2, further comprising a trim component adjustably attaching the convex panel to the boat hull.

4. The boat hull shield of claim 3, wherein the trim component is attached to the aft end of the boat hull.

5. The boat hull shield of claim 4, wherein the trim component comprises a spring-loaded bolt and nut set passing through the aft overhang.

6. The boat hull shield of claim 1, wherein the convex panel comprises a low-friction hard surface.

7. The boat hull shield of claim 6, wherein the convex panel includes a suspension component for absorbing impact forces to the convex panel.

8. The hull shield of claim 7, wherein the suspension component comprises a spring deployed between the convex panel and the boat hull.

9. The hull shield of claim 7, wherein the suspension component comprises a foam material deployed between the convex panel and the boat hull.

10. The hull shield of claim 7, wherein the suspension component comprises an airbag deployed between the convex panel and the boat hull.

11. The hull shield of claim 6, wherein the convex panel comprises polyethylene.

12. The hull shield of claim 6, wherein the convex panel comprises a multi-layered composite material.

13. A boat hull comprising:

a hull perimeter bracket extending along substantially the entire length of a port side and a starboard side of the boat hull including over a bow end of the boat hull;

a convex panel underlying at least a portion of the boat hull, the convex panel having an outer edge including a port side edge and a starboard side edge, the entire port side and starboard side edges engaging the bracket, the convex panel extending beyond an aft end of the boat hull to form an aft overhang; and a trim component attached to the aft overhang for adjusting an angle of a surface of the convex panel;

wherein the convex panel covers substantially the entire bottom surface of the boat hull extending from a port chine to a starboard chine of the boat hull and from an aft end to the bow end of the boat hull.

14. The boat hull of claim 13, wherein the trim component comprises a spring-loaded bolt and nut set passing through the aft overhang.

15. The boat hull of claim 13, wherein the convex panel comprises a low-friction hard surface.

16. The boat hull of claim 15, wherein the convex panel includes a suspension component for absorbing impact force on the low-friction hard surface of the convex panel.

17. The boat hull of claim 16, wherein the suspension component comprises a spring deployed between the convex panel and the boat hull.

18. The boat hull of claim 16, wherein the suspension component comprises an airbag deployed between the convex panel and the boat hull.

19. A boat hull comprising:

a hull perimeter bracket extending along substantially the entire length of a port chine and a starboard chine of the boat hull including over a bow end of the boat hull;

a convex panel for covering a bottom surface of the boat hull, having an outer edge including a port side edge and a starboard side edge, the entire port side and starboard side edges engaging the bracket, extending from the port chine to the starboard chine of the boat hull and extending from the bow end to an aft end of the boat hull, the convex panel having a low-friction hard surface for sliding over hard obstacles; and a suspension component for absorbing impact force on the low-friction hard surface of the convex panel;

wherein the convex panel covers substantially the entire bottom surface of the boat hull extending from the port chine to the starboard chine of the boat hull.

20. The boat hull of claim 19, wherein the suspension component comprises a spring deployed between the convex panel and the boat hull.

21. The boat hull of claim 19, wherein the suspension component comprises an airbag or bladder deployed between the convex panel and the boat hull.

22. The boat hull of claim 19, further comprising a chine attached to the bracket.

23. The boat hull of claim 22, wherein the chine includes one of a plurality of chine shapes, each chine shape being suitable for a corresponding boat hull performance feature.

* * * * *